United States Patent [19]

Rowe et al.

[11] Patent Number: 4,622,068

[45] Date of Patent: Nov. 11, 1986

[54] SINTERED MOLYBDENUM ALLOY PROCESS

[75] Inventors: Charles E. D. Rowe, Billericay; George R. Hinch, Stanford-le-Hope, both of England

[73] Assignee: Murex Limited, Essex, England

[21] Appl. No.: 797,294

[22] Filed: Nov. 12, 1985

[30] Foreign Application Priority Data

Nov. 15, 1984 [DE] Fed. Rep. of Germany .... 3441851

[51] Int. Cl.[4] ..... B22F 1/00

[52] U.S. Cl. ..... 75/245; 419/32; 419/35; 419/46; 419/54; 419/58; 420/429

[58] Field of Search ..... 75/245; 419/32, 35, 419/46, 54, 58; 420/429

[56] References Cited

U.S. PATENT DOCUMENTS 4,227,926 10/1980 Hirsch ..... 419/45
4,400,213 8/1983 Sheinberg ..... 419/19
4,491,559 1/1985 Grab et al. ..... 419/39

FOREIGN PATENT DOCUMENTS 803460 10/1958 United Kingdom .

*Primary Examiner*—Stephen J. Lechert, Jr.
*Attorney, Agent, or Firm*—Pennie & Edmonds

[57] ABSTRACT

The present invention provides a molybdenum alloy which suitably comprises in the range of from 0.2 to 1.0% by weight of an oxide of a specified metal prepared by adding a salt of the metal in dissolved form to molybdenum and/or a molybdenum oxide or a mixture of different molybdenum components, reducing this mixture at a temperature of up to 1150° C. using hydrogen, pressing the reduced metal without the addition of a binder suitably under a pressure of from 150 to 300 mPA, and sintering the product at a temperature in the range of from 1750° to 2200° C. It is preferable to add salts of zirconium to the molybdenum oxide.

15 Claims, No Drawings

SINTERED MOLYBDENUM ALLOY PROCESS

The present invention is concerned with an alloy based on molybdenum which is creep-resistant up to high temperatures and is stable even under a reducing atmosphere, and its preparation.

Molybdenum's high melting point, good modulus of elasticity, stability at relatively high temperatures and high resistance to corrosion make possible and necessary its use for many varied and extremely demanding purposes.

In order further to improve the properties of molybdenum, especially its resistance to high temperature, molybdenum alloys containing carbides are used. The so-called TZC alloy, which contains 1.25% Ti, from 0.15 to 0.5% Zr, and from 0.15 to 0.3% C, is especially resistant to high temperature. The TZM alloy, which contains less carbon and from 0.4 to 0.5% Ti, from 0.06 to 0.12% Zr and from 0.01 to 0.04% C, does not, however, achieve the high temperature resistance of the TZC alloy. Such alloys are used as cores for the injection moulding of aluminium and for dies in the diecasting of brass and stainless steel. The use of these alloys is also recommended for the manufacture of gas-turbine components, valves and nozzles in the propulsive units of rockets. A disadvantage of these alloys is, however, the fact that they are far more difficult and expensive to process than molybdenum alone, as they have to be sintered under partial vacuum in the presence of dry hydrogen to prevent composition changes and as they only acquire the desired properties after subsequent thermal treatment.

In addition to its use in the metal industry and rocket technology, molybdenum is becoming increasingly important as a corrosion-resistant material in the construction of chemical apparatus and as a construction material in the furnace industry. Molybdenum is of especial importance as a material for heating conductors and radiation shields in high-temperature furnaces, as it can be used especially in a hydrogen atmosphere at up to 2000° C. or in vacuo up to 1600° C. At such high temperatures, the alloys mentioned above exhibit improved properties over molybdenum alone. Nevertheless the service life and creep-resistance of these and other alloys proposed have still been limited and therefore in need of improvement.

For example, the HT alloy—molybdenum containing potassium and silicon—recrystallises and loses strength. This alloy can only be processed if strict manufacturing conditions, which must be rigidly adhered to, are followed. Attempts have also been made to use compound alloys that contain vanadium, boron and carbon in addition to molybdenum (DE-OS No. 32 23 618) or molybdenum plus titanium, zirconium, hafnium, or a rare earth metal, in all cases along with carbon (DE-OS No. 26 17 204), to manufacture alloys of high stability to heat and resistance to chemicals, without losing hardness.

None of these alloys, especially the alloys containing carbide, are stable in a damp hydrogen atmosphere, for example in furnaces using refractory bricks and flame curtains, as under these conditions decarburisation takes place, which leads to a corresponding loss of creep-resistance.

There is therefore a need for a molybdenum alloy which also resists such extreme conditions.

We have developed a molybdenum alloy which has improved properties over molybdenum alone and over the alloys mentioned above which does not require such rigorous or stringent processing conditions.

The present invention provides a process for the preparation of a molybdenum alloy which comprises the steps of blending molybdenum and/or a molybdenum oxide with a solution of a salt of a suitable metal (as defined herein), subjecting the mixture, after, if necessary, drying, crushing, and screening, to a reducing hydrogen atmosphere at a temperature not greater than 1150° C., further processing to form a shaped article by techniques known for processing powdered molybdenum, and sintering under a hydrogen atmosphere at a temperature in the range of from 1750° C. to 2200° C., without the addition of carbon or a carbon-containing compound at any stage in the process.

It was discovered, surprisingly, that alloys of molybdenum with only small amounts of the specified metal oxides and no carbon content are stable even at temperatures of more than 1600° C., for example also in a damp hydrogen atmosphere, and maintain creep resistance and strength under such extreme conditions.

The metal oxide content of an alloy prepared by a process of the present invention is given by the metal salt used which converts to the oxide form during the various processing steps.

The blending step may be carried out either by the usual technique of mixing the molybdenum component with the metal salt solution to form a slurry or by spraying the solution onto the molybdenum component to give a moist mixture; the latter is a technique which we have devised and which gives surprisingly good results and advantages over the usual method. Where direct mixing occurs, the slurry formed must be dried, crushed and screened to give the necessary powder form for further processing. We have found that by spraying the solution onto the molybdenum component, the moist mixture formed can be utilised without any further treatment being necessary for further processing to form the alloy.

Preferably, therefore, the metal salt solution is sprayed onto the molybdenum component in a suitable mixer, for example a mechanical rotary mixer. The mixer used should, of course, be corrosion resistant, for example by having a rubber lining. The solution may be sprayed using a suitable sprayer or nozzle apparatus. A pressurised air sprayer has been found to be especially useful. Preferably, when all of the spray has been used up, the molybdenum component and metal salt component are further blended in the mixer for a short period of time, suitably for a period of half an hour, especially for a period of 15 minutes. The further mixing ensures a homogenous distribution of the components. The mixture obtained is usually moist but not wet and there is no need for any drying, crushing or screening treatment at this stage.

The molybdenum component may be pure molybdenum or a molybdenum oxide. Alternatively, a mixture of molybdenum and one or more molybdenum oxides may be used, or a mixture of molybdenum oxides may be used.

Starting products for the manufacture of such alloys include industrially pure molybdenum dioxide or molybdenum trioxide such as is obtained by working up the ore via the ammonium molybdate or molybdic acid route. As mentioned above, it is also possible to use a mixture of such oxides or such a mixture together with pure molybdenum. The molybdenum oxide is intimately mixed with a solution of a suitable metal salt in a suitable apparatus. The solution is preferably an aqueous solution, and is suitably acidified, if necessary to maintain the salt in solution. Depending on the molybdenum oxide used, the mixture of the oxides is reduced to the metal in one or two steps in a hydrogen atmosphere at temperatures of up to 1150° C., preferably at a temperature in the range of from 850° to 1150° C., especially at 1050° C. During this process, the metal salts added in small amounts hydrolyse to form the hydroxides and finally remain homogeneously distributed in the metal in the form of oxides.

By the term "suitable metal" used herein, there is to be understood a metal which in salt form forms a solution with a suitable solvent which gives rise to an oxide of the metal under the conditions of the process of the invention without further decomposition or pemanent alteration from the solid phase. Metal here includes a metalloid or element having metal-like properties. Thus, metals the oxides of which melt at a temperature of 1500° C. or above and which form an oxide dispersed hardened molybdenum alloy, are suitable and such oxides are, for example, those which remain solid and dispersed in the molybdenum under the conditions of the process, for example during sintering, or which melt during sintering and then precipitate to form a disperse phase in the molybdenum metal on cooling. Metals, the oxides of which melt during the reducing or sintering treatments and do not precipitate to form an oxide dispersed hardened material, would be unsuitable.

Especially suitable metals are aluminium, barium, calcium, cerium, chromium, hafnium, magnesium, silicon, strontium, thorium, yttrium, zirconium, and similar metals. In the process of the invention, it is preferred to use a salt of aluminium, chromium, hafnium, titanium, or zirconium. It is especially preferred to use an aluminium, chromium, or zirconium salt where the resultant alloy is to be used in the nuclear industry.

It is possible to use a mixture of salts in the process of the invention which will give rise to an alloy containing the corresponding mixture of metal oxides. It is also possible for a salt of two suitable metals to be used.

The salt used should be a salt which is soluble, or can be maintained in solution, in a suitable solvent and which gives rise to an oxide of the suitable metal under the conditions of the process of the invention. The salt is preferably a chloride, iodide, sulphate, or nitrate.

Especially, the salt of a suitable metal used is zirconium nitrate. Suitably this salt is used in an aqueous solution which may be freshly prepared or a commercially available solution, for example a 20% by weight solution. The aqueous solution of zirconium nitrate may be acidified for use in the process of the invention.

The amount of salt used is suitably such as to give an alloy containing in the range of from 0.2 to 1.0% by weight of an oxide of a suitable metal, preferably 0.25 to 0.6% by weight, especially 0.3 to 0.6% by weight, of metal oxide.

The solvent used in the process of the invention may by any suitable solvent, and is preferably water.

When using the metal alloy in nuclear technology it must however be ensured that only salts of metals, the oxides of which have as small as possible a thermal neutron capture cross-section, are added to the molybdenum component. Since these alloys contain no carbon, no further reducing agent that would reduce the metal oxides is present after the reduction of the molybdenum oxide to the metal.

It is also usually unnecessary to use binders at any stage in the process of the invention. As a result no impurities, especially no carbon, enter the alloy, and its properties thus remain unaffected.

The powder obtained in the process of the invention may be processed according to known molybdenum powder processing techniques, without the use of any special conditions or precautions. For example, the use of a partial vacuum, dry hydrogen atmosphere in the sintering step is unnecessary, although an atmospheric or low pressure hydrogen atmosphere is preferably used.

The resulting metal powder is sieved suitably initially through a −10 mesh sieve, and then through a −240 mesh sieve. The grains thus obtained have a particle size in range of from 2 to 8 microns (mean particle size, Fisher sub sieve sizer). The powder is pressed under a pressure in the range of from 150 to 300 mPa to form shaped articles, for example rods or bars, and heated in a retort furnace for in the range of from 3 to 72 hours, at a temperature in the range of from 1750° to 2200° C., preferably at approximately 1850° C., depending on the size of the article and the particle size of the powder. During this process the metal sinters to form a solid block and then has a density of more than 91% of theoretical density. If this density is not reached, it is necessary for the sintering to be carried out again for several hours. Where bars are formed they can be rolled into sheets in known manner using temperatures and reduction steps as for pure molybdenum. The surface is normally bright; it can be etched with acids to give it a matt finish.

A further advantage of this alloy is that it can be welded by conventional argon-arc techniques using, if necessary, filler rods (or electrodes) of the same or different molybdenum-based material. Electron-beam welding of the metal is also possible. The metal is advantageously tempered at 950° C. after being welded.

The metal can be used in a great variety of areas in which high temperature resistance and high corrosion resistance, especially under reducing conditions, are important.

The following Example illustrates the invention.

EXAMPLE 70 kg of pure molybdenum dioxide are introduced into a rubber-lined or corrosion-resistant cement mixer. 0.69 kg of zirconium nitrate are dissolved in 4 litres of water with the addition of a small amount of nitric acid. The nitric acid is intended to prevent premature hydrolysis of the zirconium nitrate and to keep the latter in solution. The zirconium nitrate solution is sprayed by means of a suitable nozzle onto the molybdenum oxide that is kept moving in the mixer. When the addition of the nitrate solution is complete, mixing is continued for a further 5 to 15 minutes. The mixture is then damp, but not wet. The mixture is then heated, without intermediate drying, in molybdenum alloy or nickel alloy trays in a hydrogen atmosphere, the temperature rising slowly to 1150° C. While the molybdenum oxide is reduced to metal, the zirconium nitrate decomposes to form zirconium dioxide and is uniformly distributed in the molybdenum powder. The resulting metal powder is sieved, first through a 10 mesh (~1.7 mm) sieve and then through a 240 mesh (18 0.064 mm) sieve. The grains greater than 10 mesh and greater than 240 mesh are discarded. The fine grains of less than 240 mesh are pressed to form rectangular bars without the addition of a binder. The bars are heated for 45 hours in a retort furnace at 1850° C. in a hydrogen atmosphere. After the sintering process the material has a density of approximately 93% of theoretical density. The metal can be processed into sheets by rolling.

Analogous alloys are obtained using aluminium, chromium, titanium or hafnium salts.

We claim:

1. A process for the preparation of a sintered molybdenum alloy which comprises the steps of blending molybdenum and/or a molybdenum oxide with a solution of a salt of a metal which solution under the conditions of the process gives rise to and oxide of the metal without further decompostion or permanent alteration from the solid phase subjecting the mixture, after, if necessary, drying, crushing, and screening,to a reducing hydrogen atmosphere at a temperature not greater than 1150° C., further processing to form a shaped article by techniques known for processing powdered molybdenum, and sintering under a hydrogen atmosphere at a temperature in the range of from 1750° C. to 2200° C., without the addition of carbon or a carbon-containing compound at any stage in the process.

2. A process as claimed in claim 1, wherein the solution of a metal salt is sprayed onto the molybdenum and/or molybdenum oxide and blended in a suitable mixer to give a moist mixture.

3. A process as claimed in 1 or claim 2, wherein molybdenum dioxide or molybdenum trioxide or a mixture thereof is used.

4. A process as claimed in any one of claims 1 to 3, wherein the amount of metal salt used is such that the alloy prepared contains in the range of from 0.2 to 1.0% by weight of an oxide of the metal in the resulting prepared alloy.

5. A process as claimed in claim 4, wherein the amount of metal salt used is such that the alloy prepared contains in the range of from 0.25 to 0.6% by weight of an oxide of the metal.

6. A process as claimed in any one of claims 1 to 5, wherein the salt used is a salt of a metal selected from aluminium, barium, calcium, cerium, chromium, hafnium, magnesium, silicon, strontium, thorium, yttrium, and zirconium, or a mixture of two or more such salts is used.

7. A process as claimed in claim 6, wherein a salt of aluminium, chromium, hafnium, titanium, or zirconium, or a mixture of two or more such salts is used.

8. A process as claimed in claim 7, wherein a salt of zirconium is used.

9. A process as claimed in any one of claims 6 to 8, wherein the salt is a chloride, iodide, sulphate, or nitrate salt.

10. A process as claimed in claim 9, wherein the salt is zirconium nitrate.

11. A process as claimed in claim 1 which further comprises drying, crushing, and/or screening the mixture prior to the hydrogen reducing step.

12. A process as claimed in any one of claims 1 to 11, wherein the further processing is carried out in the absence of a binder.

13. A process as claimed in any one of claims 1 to 12, wherein the sintering is carried out under a hydrogen atmosphere at atmospheric pressure or a reduced pressure.

14. A molybdenum alloy prepared by a process as claimed in any one of claims 1 to 12.

15. A molybdenum alloy as claimed in claim 14, which comprises molybdenum and in the range of from 0.2 to 1% by weight of an oxide of a metal.

* * * * *

UNITED STATES PATENT AND TRADEMARK OFFICE

CERTIFICATE OF CORRECTION

PATENT NO. : 4,622,068

DATED : November 11, 1986

INVENTOR(S) : Charles E.D. Rowe, et al.

It is certified that error appears in the above-identified patent and that said Letters Patent is hereby corrected as shown below:

In claim 1, line 5, change "and" to --an--.

In claim 1, line 6, change "decompostion" to --decomposition--.

In claim 1, line 6, change "phase subjecting" to --phase, subjecting--.

Signed and Sealed this

Thirteenth Day of October, 1987

*Attest:*

DONALD J. QUIGG

*Attesting Officer*

*Commissioner of Patents and Trademarks*